US005232312A

United States Patent [19]

Jennings et al.

[11] Patent Number: 5,232,312

[45] Date of Patent: Aug. 3, 1993

[54] SHORING DEVICE

[76] Inventors: Charles B. Jennings, 8951 W. Windsor, Phoenix, Ariz. 85037; Gregory St. George, 2173 W. Waltann Dr., Phoenix, Ariz. 85029; Warren France, 1347 Black Canyon Stage II, Phoenix, Ariz. 85027

[21] Appl. No.: 873,092

[22] Filed: Apr. 24, 1992

[51] Int. Cl.[5] ..... E02D 17/06

[52] U.S. Cl. ..... 405/282; 405/272

[58] Field of Search ..... 405/258, 272, 274, 282, 405/283

[56] References Cited

U.S. PATENT DOCUMENTS 3,470,699 10/1969 Cox ..... 405/282
3,851,856 12/1974 Berg ..... 405/282 X
4,682,914 7/1987 Aihara et al. ..... 405/283
4,787,781 11/1988 Bradberry ..... 405/282
4,863,315 9/1989 Wickberg ..... 405/274 X
5,066,353 11/1991 Bourdo ..... 405/274 X

*Primary Examiner*—David H. Corbin
*Attorney, Agent, or Firm*—Gregory J. Nelson

[57] ABSTRACT

A shoring device for supporting a trench. The device has opposite shields of non-conductive material such as fiberglass. Hydraulic actuators extend between the shields. A spring return assembly also extends between the shields and is enclosed in a tube. A positive locking device may be secured to either the actuator or spring return assembly. In an alternate embodiment, the shields may have removable sections to accommodate obstructions in the trench.

10 Claims, 3 Drawing Sheets

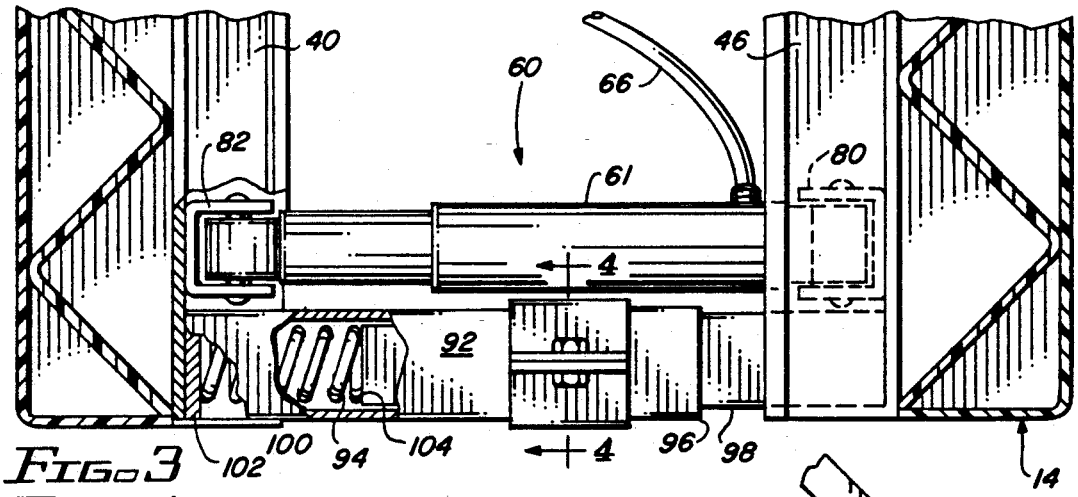
FIG. 3
FIG. 4
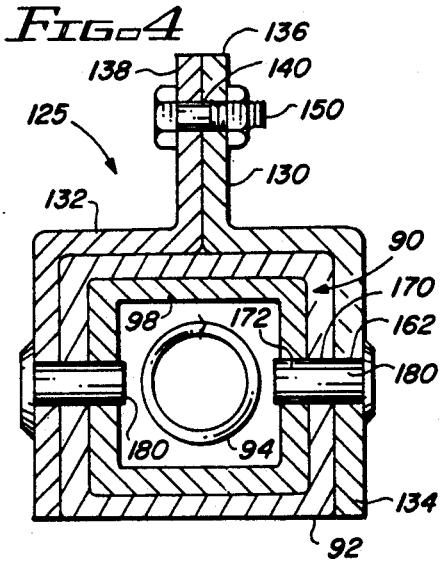
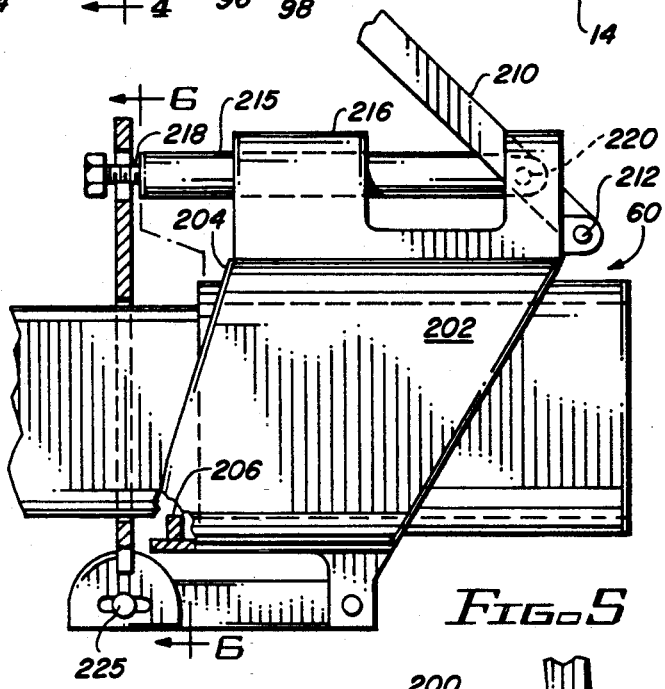
FIG. 5
FIG. 6
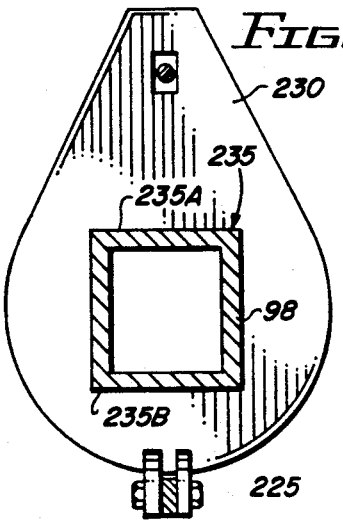
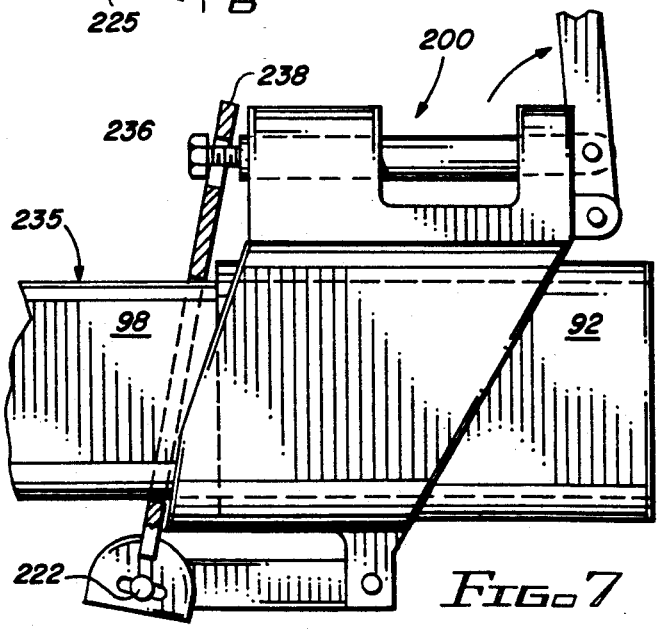
FIG. 7

SHORING DEVICE

The present invention relates to a shoring device and particularly to the type of shoring device which is used to support the side walls of an excavation such as a trench during construction.

Sound construction safety practice and OSHA standards for safe trenching practices require that the side walls of trenches be supported or shored against collapse. The particular shoring requirements varies with soil composition and trench size. Generally with stable soils, state or federal regulations require trenches having a depth greater than approximately four to five feet be vertically shored to avoid exposing workers to the hazards of unshored trenches.

When excavating unstable soils, additional safety precautions may be necessary. In these instances, the shoring device may incorporate sheeting or whalers. These devices utilize vertical members adjacently spaced or closely spaced which are held in place against the opposite trench walls by extendable, hydraulic units. Typical of these units are those manufactured and offered by Safe-T-Shore of Tempe, Ariz. under the designation "SAFE-T-SHORE Shoring Devices".

While shoring devices of the general type have found wide acceptance and have minimized the hazards of construction to workers, certain excavations may require customized or specialized shoring devices which have additional features beyond those conventionally utilized in the art. These additional features include provision of shields or panels which are electrically nonconductive and the incorporation of positive locking mechanisms to prevent inadvertent collapse of the shoring device.

Briefly, the present invention provides an improved shoring device having a pair of oppositely disposed shoring shields constructed of a nonconductive material, preferably fiberglass. In a preferred embodiment, the inner surface of the shields are a corrugated fiberglass panel for strength and outer surfaces which are each a generally planar, trench-engaging panel which is bonded to the corrugated panel. One or more hydraulic or pneumatic cylinders extend between the shields and are secured at the opposite interior surface of the panels at frame members. A return spring extends between the opposed shields and is enclosed in a telescoping spring return tube. A positive lock is associated with either the cylinders or the return tube for locking the shoring device in the extended, trench-supporting position. The locking device may be a bracket and an associated pin which is engageable in bores which are located in the spring return tubes. In an alternate embodiment, the locking device is a toggle-type locking device with a locking plate which is moveable from a nonlocking position to a locking position engaging the extendable cylinder rod or telescoping spring return tube. The shields or panels may be provided with removable sections to accommodate obstructions such as a utility that may extend across the trench.

The above and other objects and advantages of the present invention will become more apparent from the following description, claims and drawings in which:

FIG. 3 is a sectional view taken along line 3—3 of FIG. 1;

FIG. 4 is a sectional view taken along line 4—4 of FIG. 3;

FIG. 5 is a side view of an alternate embodiment of a positive locking device that may be associated with the cylinder or telescoping spring return tube;

FIG. 6 is a sectional view taken along line 6—6 of FIG. 5;

FIG. 7 is a view similar to FIG. 5 showing the positive locking device in a locked position;

Figure 1:
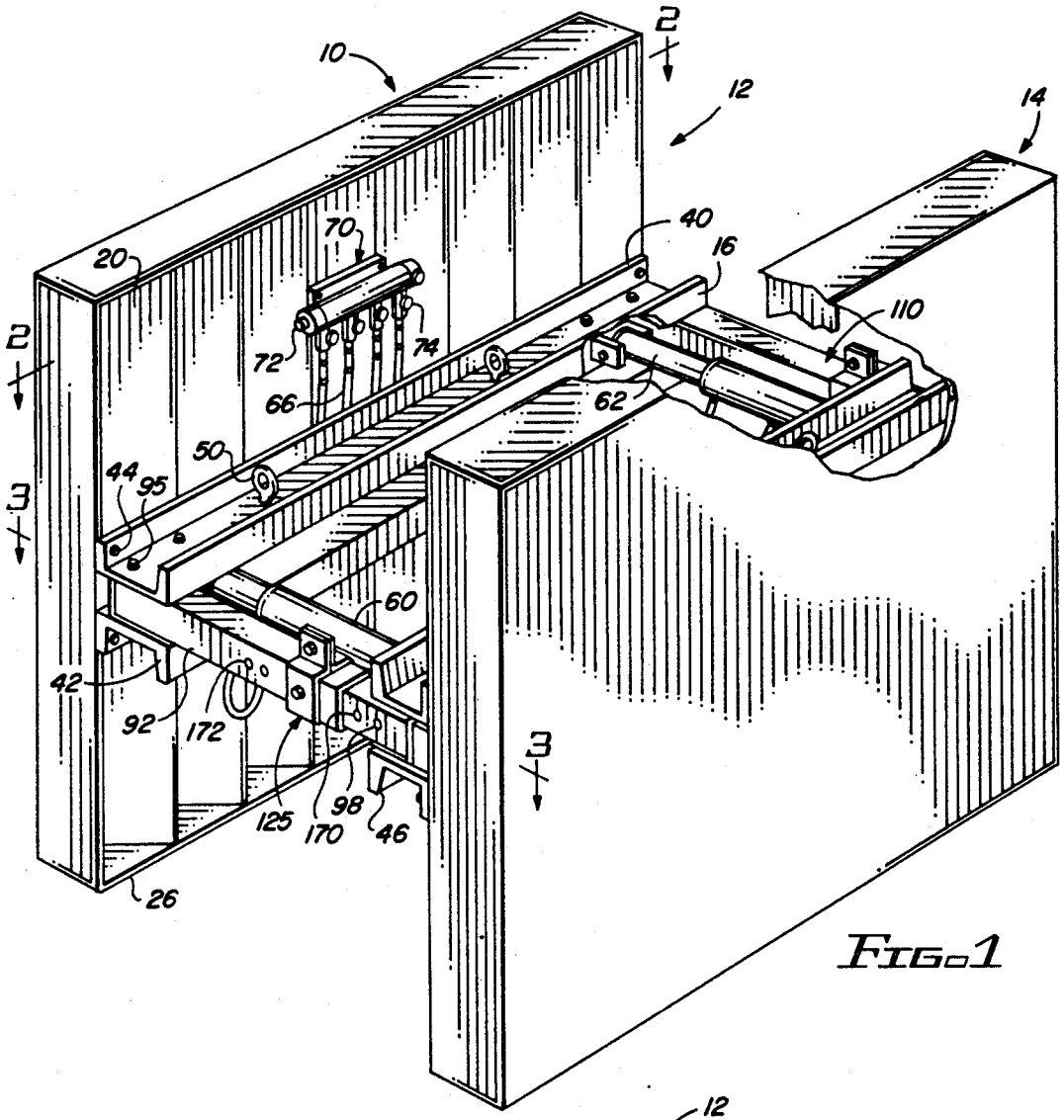
FIG. 1 is a perspective view of the shoring device of the present invention partly broken away to better illustrate the details of the components.
Figure 2:
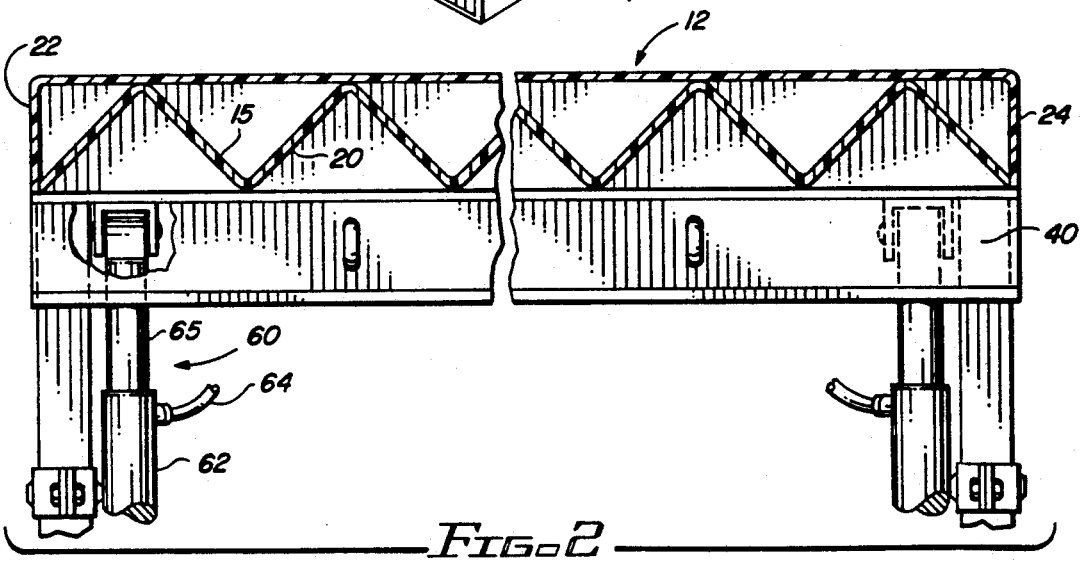
FIG. 2 is a sectional view taken along line 2—2 of FIG. 1.

Turning now to the drawings, particularly FIGS. 1 to 5, a preferred embodiment of the shoring device of the present invention is shown. As indicated above, the shoring device is for placement in a trench when excavating soil. The purpose of the shoring device is to support the opposite side walls of the trench to reduce the possibility of collapse of the side walls during construction activities. In some soils, particularly more unstable soils, shoring devices are used which have substantially continuous sheeting or walls which engage the opposite trench walls. The shoring device of the present invention is generally designated by the numeral 10 and generally consists of opposed shoring shields 12 and 14 interconnected by an extendable and retractable frame assembly 16. The shoring shield 12 and 14 are similarly constructed and as seen in FIGS. 1 and 2 include an inner panel 20 which is shown as a sheet of corrugated, nonconductive material such as fiberglass. The corrugations 15 in panel 20 increase the overall strength of the shield assembly. Panel 20 extends laterally between opposite end plates 22 and 24. The shields 12 and 14 are each generally rectangular having a bottom plate 26 and a top plate 28. In practice, the individual shoring devices 10 will normally be placed in adjacent or abutting relationship with, for example, end plate 24 of one section abutting the end plate 22 of the next adjacent shoring section. The nonconductive shoring shields are fabricated by any conventional method consistent with the characteristics of the material, as for example in the case of fiberglass bonding using suitable adhesives such as epoxy has been found to work well.

The mechanism for extending and retracting the opposed shield includes horizontal whaler 40 secured to the inner face of shield 12. The whaler 40 is a beam structure as shown having a general C-configuration. Whaler 40 is secured to the inner side of shield 12 by appropriate fasteners 44. Whaler 46 is similarly secured to the interior face of opposite shield 14. Lifting lugs 50 are secured to whalers 40 and 46 at spaced-apart locations to provide convenient points of attachment for a cable or chain for easy and rapid installation and removal of the shields using a crane or backhoe.

As indicated above, the shoring devices are positioned in the trench either as shoring devices or as static barriers. When used as shoring devices, the device is extended so that the shields 12, 14 engage the opposite trench walls to support the walls. In order to extend and retract the shields, a hydraulic system is provided which includes a pair of hydraulic cylinders 60 and 62 extending between the shields. Cylinder 60, shown as a single acting device, includes a housing 61 having an extendable rod 65. As is well known, the head end of the cylinder housing is connected to a source of hydraulic fluid pressure by means of hydraulic line 66. Pressurization of the head end of the cylinder will cause the rod 65 to extend and release of pressure will allow the cylinder to retract. Manifold 70 located on shield 12 is provided with quick connect 72 so the manifold may be easily connected to a portable source of fluid pressure for pressurization and extension of the cylinders. Manifold 70 is provided with conventional valves 74 to pressurize and evacuate the head end of the cylinder to cause the shoring devices to extend or retract.

As best seen in FIG. 3, the head end of the cylinder is secured to shield 14 at a cylinder pad 80 which is secured to whaler 46. Similarly, the rod end 65 of hydraulic cylinder 60 is connected to socket pad 82 which is secured to whaler 40 at shield 12. As best seen in FIG. 1, cylinder 62 is similarly secured to whaler 40 at shield 12 and whaler 46 at shield 14 near the opposite, vertical edge of each of the shields. Additional whalers and cylinder assemblies may be provided at vertically spaced-apart locations along the shields as required by safety standards. Typically, additional devices are required if the shields are over four feet high. For clarity, only one such whaler and cylinder assembly is shown.

As indicated above, when it is desired to remove or re-position the shields, the cylinders 60 and 62 are retracted by operating hydraulic manifold control valve 74 to release the pressure from the head end of the cylinders. Once this is done, the cylinders are free to retract. However, in order to provide a positive retraction, force to assist in pulling the shields away from the trench walls, a spring return mechanism is provided. The first spring return mechanism is generally designated by the numeral 90 and extends transversely between the shields and is positioned adjacent cylinder 60. The spring return mechanism includes a tube member 92 which is shown as being generally square in cross section and defining an interior chamber 94. One end of tube 92 is secured at whaler 40 by mechanical fastener 95. The opposite end of channel 90 terminates at end 96 at a location spaced a distance from shield 12 normally less than the width of the typical trench. Tube 98 is telescopically received within chamber 94 of tube 92. One end of tube 98 is secured to whaler 46 extending at the surface of shield 14. A compression spring 100 extends within chamber 94 having one end secured to the end wall 102 of tube 92 at shield 12. The opposite end of spring 100 is secured to the inner end 104 of telescoping tube 98. A second return spring assembly 110 is located adjacent cylinder 62 and is constructed the same or similar to assembly 90. Thus, it will e seen that spring 100 exerts a force tending to pull the shields 12 and 14 together to a retracted or partially retracted position. In the normal, installed position, the force exerted by the hydraulic fluid cylinders 60, 62 will overcome the spring force exerted by the assemblies 90 and 110 and hold the springs 100 in an extended position. When the fluid pressure in the cylinders is released, the spring force will return the shoring device to a retracted position so that the device may be easily replaced or removed from the trench. The spring return assembly 110 is similar in construction to return assembly 90 and is positioned immediately adjacent hydraulic cylinder 62. Detailed description of the construction of this mechanism is not believed necessary as it is the same or substantially the same as has been described with reference to assembly 90.

The shoring device of the present invention is also provided with a positive locking device 125 which will assist in securing and maintaining the shoring device in an extended, installed position. The locking device is best seen in FIGS. 1, 3 and 6 and is securable about the spring return assemblies 90 and 110. As shown in FIG. 4, a pair of clamp members 130 and 132 fit about the spring return assemblies. Each of the clamp members has a body 134 which extends about a portion of the exterior of the body of tube 90. A pair of flanges 136 and 138 extend outwardly from clamp members. Flanges 136 and 138 define bores 140 which align. The clamp sections 132 and 134 are secured in place by bolt 150. Pins 180 extend inwardly from the opposite clamp members. Bores 170 are provided in opposite side walls of the tube 92 which bores align with the bores 172 in the tube 98. In use, the coupling halves are loosely assembled about the outer spring return tube using fasteners 150 and 152. Once the shoring device is extended to the desired position with the bores in the locking device and the spring return tubes in alignment, pins 180 are inserted through the assembly. Thereafter, fastener 150 is tightened locking the tubes in position and securing the shoring device in the event of a hydraulic or other failure which would otherwise cause the device to retract. When it is desired to remove or reposition the shoring device, the positive locking device 125 is removed and hydraulic pressure released form the head end of the actuating cylinders as described above.

FIGS. 5 through 7 show another form of locking device which may be positioned on the spring return mechanism or, as shown, may be secured to the hydraulic actuator cylinders 60, 62. The locking device, generally designated by the numeral 200, is shown positioned on cylinder 60. The locking device has a body 202 which defines a generally cylindrical bore 204 which is slidable over the body of the associated cylinder in the position shown with an abutment 206 engaging the outer end of the cylinder body 61. The locking device includes an operational lever 210 which is pivotally secured to the body 202 at pivot 212. At an intermediate location spaced from pivot 212, rod 215 is slidable within horizontal bore 216 formed as part of the body 202. One end of the piston 215 is pivotally secured to the lever. 210 at pivot 220. Locking plate 230 is pivotally secured to body 202 at pivot pin 225 diametrically opposite the rod 215. The locking plate has an opening 235 defined therein which closely approximates the configuration of the tube 98, which in this case is shown as being generally square. The upper end of locking plate 230 is secured to the outer end of the rod 215 by means of screw 236 which extends through aperture 238 in the plate and is in threaded engagement with internally threaded bore 218 at the end of the rod 215. As indicated above, the opening 235 in the locking plate is closely sized to correspond to the outer configuration and dimensions of the tube 98. Thus, when the lever 210 is moved downwardly to the position shown in FIG. 5, rod 215 will be moved outwardly bringing the locking plate to a more or less vertical position as shown in FIG. 5. In this position, opening 235 will permit the tube 98 to slide within the opening. However, when the actuating lever 210 is pivoted upwardly to the position shown in FIG. 7, the rod 215 will move rightwardly, swinging the locking plate to the position shown in FIG. 7. In this position, the locking plate forms an acute angle with respect to the longitudinal axis of the tube 98. This will also bring the opposite horizontal edges 235A and 235B of the opening into engagement with the surface of the tube. This frictional engagement between the edges 235A, 235B, of the opening in the locking plate and the surfaces of the tube 98 will resist movement of the telescoping tube serving to assist in locking the shoring device in a fixed position, even in the event of hydraulic failure.

As indicated above, the locking device may be associated with the telescoping tube which protects the spring return or may be configured to be placed about one or both of the hydraulic actuating cylinders with the locking plate engageable with the surface of the cylinder rod.

Figure 8:
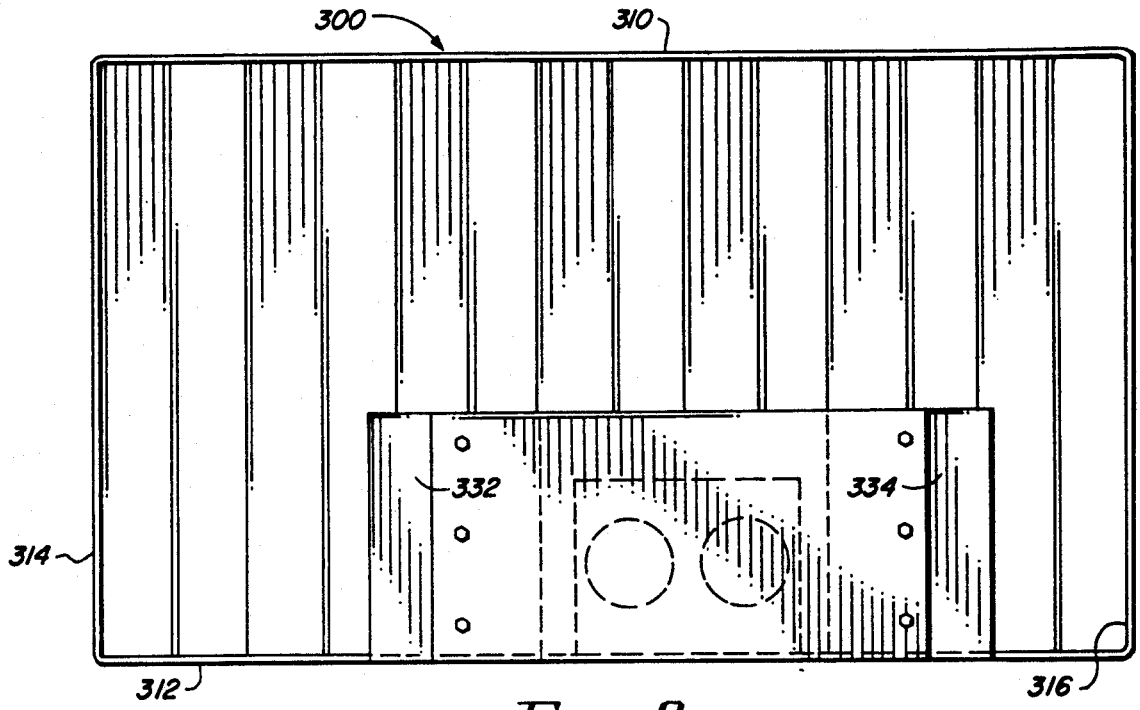
FIG. 8 is a front view of the exterior of the shoring shield having a removable section with a typical obstruction shown in dotted.
Figure 9:
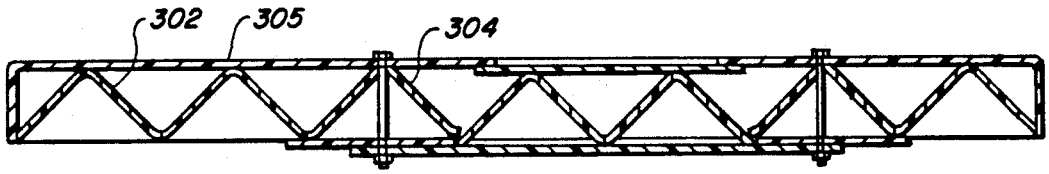
FIG. 9 is a sectional view taken along line 9—9 of FIG. 8.
Figure 10:
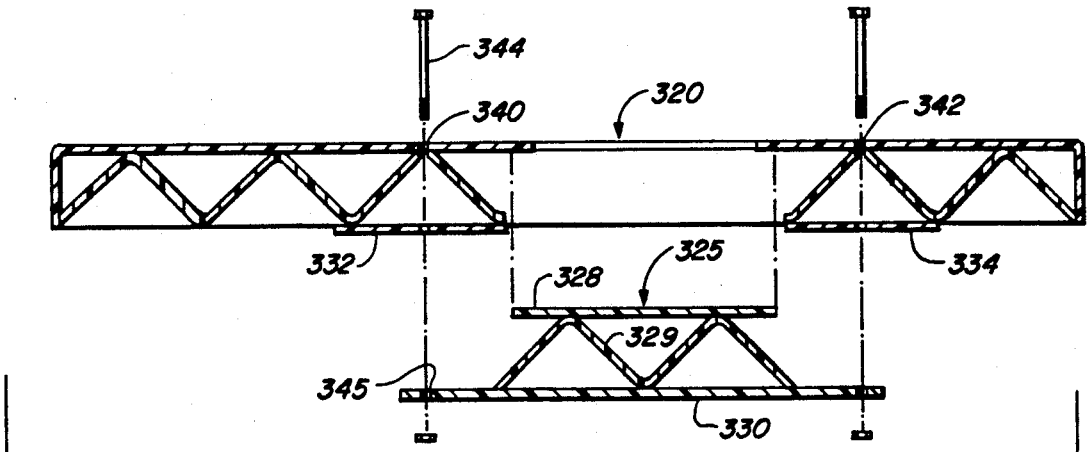
FIG. 10 is a sectional view similar to FIG. 9 illustrating the removable section detached from the shield.

Another problem that is often encountered in trenching activities is the existence of utilities in the trench. For example, a conduit may cross the trench and, when placing the shoring device, the location of the conduit presents an obstacle to the effective shoring of the trench. Accordingly, the shoring device of the present invention may be modified as shown in FIGS. 8 to 10 to accommodate the existence of obstacles in the trench. As shown in these figures, the shields which engage to support the trench walls, are generally designated by the numeral 300 and are constructed similar to those as shown previously. The shields are shown as being generally rectangular, fabricated from a corrugated, nonconductive material such as a sheet of corrugated fiberglass 302. The outer surface 304 of the shield is provided with a planar panel 303 of fiberglass or other similar nonconductive material. The top edge, bottom edge and side edges are preferably enclosed by sections 310, 312, 314 and 316 to provide a smooth exterior surface to which dirt and other material will not readily adhere to cling. A section of each of the opposed shields is cut away at 320. Preferably the cut-away section is at an intermediate location and, as shown, is generally rectangular in configuration. A removable panel section 325 is positioned in the cut-out areas for normal installations. The removable section 325 is shown as having a core 328 of corrugated, non-conductive material. The outer surface of the removable section is provided with panel 328 which generally conforms in size and shape to the cut out in the shield 300. The panel 328 is adhesively bonded or otherwise secured to a corrugated core 329. The inner surface of the removable section is provided with a panel 330 which is somewhat larger than the cut out and will overlap the adjacent edges of the shield 300. Panel 330 is bonded or otherwise secured to the core 328. A pair of plates 332 and 334 are secured at the interior side of the shield adjacent the cut out 320. A plurality of bores 340 are provided through the shield panel 305 and plates 332, 334 which bores align with mating bores 345, vertically arranged at the edges of panel 330. Thus, as seen in FIG. 9, the removable section can be secured in place as part of the panel assembly by means of bolts 344 and nut 346. When it is desired to make provision for an obstruction, such as an existing utility or conduit, the bolts 344 are removed as shown in FIG. 10, allowing the panel section 325 to be removed, exposing the cut-out section 320 of the panel which can then be positioned to bridge the obstacle in the trench.

Thus, it will be seen that the present invention provides a shoring device which is lightweight, nonconductive and highly versatile and efficient. The arrangement allows the contractor to operate the cylinders from a single manifold and to make accommodations for obstructions that may occur within the trench. The nonconductive shields and positive locking device also enhance the safety of the system. The device can be easily installed using current installation practices with the installer working above ground to avoid exposing the worker to unshored trenches.

It will be obvious to those skilled in the art that various changes, alterations and modifications may be made to the invention described herein. To the extent these changes, alterations and modifications do not depart from the spirit and scope of the appended claims, they are intended to be encompassed therein.

We claim:

1. A portable shoring device for shoring the side walls of an excavation comprising:

(a) a pair of shields each having a generally planar soil-engaging generally planar exterior surface secured to generally corrugated panel, said shields being fabricated from a nonconductive material and being oppositely positionable with the exterior surface engaging the opposite walls of an excavation;

(b) a hydraulic actuator having head and rod ends and being operatively mounted to move said shields into engagement with said walls and to retract said shields away from said walls; and (c) return means extending between said shields including biasing means enclosed within a housing for applying a retracting force on said shields.

2. The device of claim 1 wherein said shields are fiberglass.

3. The device of claim 1 further including a hydraulic manifold attached to one of said shields at a central location and being operatively connected to said actuator.

4. The device of claim 1 further including whaler members extending transversely along the interior side of said shields wherein said actuator rod and head ends are oppositely secured to said whaler members.

5. The device of claim 1 further including a positive locking device associated with one of said actuator or return means for selectively locking said shoring device in a predetermined position.

6. The device of claim 1 wherein at least one of said shields includes a removable section detachably secured thereto to accommodate placement adjacent obstructions.

7. The device of claim 5 wherein said locking device includes a housing and a locking pin engageable with said housing and said actuator or return means.

8. The device of claim 5 wherein said locking device includes a body member, a locking plate engageable with an extendible component of said actuator or return means extending between said shields and means for selectively positioning said locking plate relative to said extendible component in a locking or non-locking position.

9. A portable shoring device for shoring the vertical side walls of a excavation comprising:

(a) a pair of opposed shields each having a substantially planar exterior fiberglass panel bonded to a corrugated fiberglass panel at an interior surface;

(b) at least one structural member extending along the interior surface of said shields;

(c) a hydraulic actuator extending between said structural members and operative to laterally extend and retract said shields between said side walls with the planar exterior surface engaging the side walls; and (d) return means separate from said hydraulic actuator including first and second tubular members each having an end secured at one of said structural members and being slidable relative to one another with spring means housed therein maintaining a biasing force to retract said shields.

10. The device of claim 9 wherein at least one shield includes a removable section detachably secured thereto whereby said section may be removed to accommodate an obstruction in the excavation.

* * * * *